US005689747A

United States Patent [19]

Jeutter et al.

[11] Patent Number: 5,689,747

[45] Date of Patent: Nov. 18, 1997

[54] DEVICE FOR INTERFACING BETWEEN A FILM DEVELOPING DEVICE AND SILVER RECOVERY UNIT

[75] Inventors: Andreas Jeutter, Steinheim; Gerhard Ueffinger, Weinstadt-Grossheppach, both of Germany

[73] Assignee: Eastman Kodak Company, Rochester, N.Y.

[21] Appl. No.: 616,405

[22] Filed: Mar. 15, 1996

[30] Foreign Application Priority Data

Mar. 17, 1995 [DE] Germany ..... 195 09 757.2

[51] Int. Cl.[6] ..... G03D 3/02

[52] U.S. Cl. ..... 396/578; 396/626; 204/273

[58] Field of Search ..... 354/298, 299, 354/324, 322; 396/626, 630, 570; 204/272, 194, 287, 275, 228, 273; 210/195.1, 269, 287, 284

[56] References Cited

U.S. PATENT DOCUMENTS 4,302,317 11/1981 Mock ..... 204/228

5,133,846 7/1992 De Niel et al. ..... 204/194

5,203,979 4/1993 Uffinger et al. ..... 204/272

FOREIGN PATENT DOCUMENTS 0 038 137 10/1981 European Pat. Off. .

*Primary Examiner*—D. Rutledge

*Attorney, Agent, or Firm*—Frank Pincelli

[57] ABSTRACT

Interface for a silver recovery unit (11) for indicating the operating condition of at least one pump (9a, 9b). A sensor (10) for detection of the operating condition of the pump (9a, 9b) is installed outside the at least one pump (9a, 9b) such that during installation an intervention in the electronic unit (24) of the pump (9a, 9b) or in the pump (9a, 9b) itself is avoidable. The output signal of the sensor (10) is passed to a series-connected electronic circuit (400) that comprises a series connection of an amplifying means (40), a first filtering means (41), a rectifying means (42), a second filtering means (43) and a comparator (44).

8 Claims, 3 Drawing Sheets

DEVICE FOR INTERFACING BETWEEN A FILM DEVELOPING DEVICE AND SILVER RECOVERY UNIT

FIELD OF THE INVENTION

The invention relates to a device for interfacing a film developing device and a silver recovery unit for checking the operating condition of the film developing device, said film developing device having at least one electric motor-driven pump.

BACKGROUND OF THE INVENTION

During film development, silver gets into the fixing solution. This fixing solution containing silver is supplied with a regenerate, i.e., fresh fixing solution, by means of a regenerating pump. This regeneration depends substantially on the developed film surface. For that reason, the film developing devices contain measuring devices that achieve regeneration of the individual baths depending on the film surface. The fixing bath is circulated continuously with the aid of a circulating pump.

The depositing of silver from the films into the fixing solution is directly proportional to the film surface, so that regeneration, i.e., operation of the regenerating pump can be used to ascertain the silver concentration in the fixing solution. The electrolysis unit is supplied with the information on the film surface throughput, from which it can ascertain the silver concentration in the fixing solution on the basis of the aforementioned proportionality.

Furthermore, it is an advantage for a functional control of the silver recovery unit when the operating state (On/Off) of the film developing device is known. This is indicated by a signal from the circulating pump.

Both signals, film surface signal and operating state signal, are to be generated by the interface and supplied to the electrolysis unit via a connecting lead. The activity of the circulating pump can be used to obtain the operating state signal. The activity of the regenerating pump is detected to generate the film surface signal.

EP-A-0 038 137 (Silver Systems Ltd., Silver recovery apparatus and method) describes a device and a method for recovering metals from a solution. In this case, the silver concentration in the fixing solution is directly measured by a sensor (probe) and passed to the silver collection cell.

In addition, DE-A-40 07 906 (Kodak, Fixer Manager) describes obtaining the film surface signal by direct signal pickup from the pump control unit of the developing machine.

The solutions described above have the following drawbacks: the first solution requires a silver sensor not at present available with the required long-term stability. For this reason, the second solution is frequently used, which does however entail tampering with the electronic control unit of the developing machine. Furthermore, it is not detected whether the circulating pump is actually operating. At present, a number of different interface cables are needed in order to connect the various types of film developing devices to the silver recovery unit.

SUMMARY OF THE INVENTION

The object underlying the present invention is therefore to create a universal device for interfacing a film developing device with the help of which a silver recovery unit can be connected quickly and simply to various equipment models and using which the operating state can be clearly monitored at the same time.

This is achieved in accordance with the invention in that a sensor for detecting the operating state of the film developing device is installed outside the at least one pump such that during installation interference with the pump itself, with the liquid lines or with the pump/machine control unit is avoidable.

The device for interfacing in accordance with the invention has a number of advantages; for example, this electric interface can be used for new equipment too (film developing machines), meaning that there is no need to develop a new and special interface cable. This therefore means, a) a widening of the field of application of the silver recovery unit; b) a cost saving, since the development of interface cables for new film developing devices is not necessary; c) the avoidance of interference with the electronic system of the film developing device and preservation of the maker's warranty; and d) quick and easy installation of the device for interfacing.

For detection of the operating state of a certain pump in the liquid circuits of a film developing device, three basic methods of signal pickup have proved advantageous.

Signal pickup via a coil is possible, since most pumps operate with electric motors. The magnetic field generated by the electric motor induces a voltage in the coil. The latter is used as a sensor that detects the operating state of the electric motor and hence of the pump. The sensor is attached directly or as close as possible to the pump.

A further advantageous possibility for signal pickup is with the aid of a Hall sensor that also responds to the magnetic field of the electric motor of the pump.

A particularly low-cost solution for signal pickup results from the use of a capacitive method. The cable for the current supply to the electric motor of the pump has a wire which acts as an electrode wound round it over a certain length. The phase line of the current cable and the wire wound around the current cable form a capacitor. Since the electronic unit in the interface keeps the potential of the wound wire at zero, the capacitive reactive current can be measured and used to indicate the on/off state of the pump.

The function principle of a circuit for processing signals provided by the sensor is explained in detail in the following description.

BRIEF DESCRIPTION OF THE DRAWINGS

The subject of the invention is described on the basis of the embodiments shown in the drawing.

DETAILED DESCRIPTION OF THE INVENTION

Figure 1:
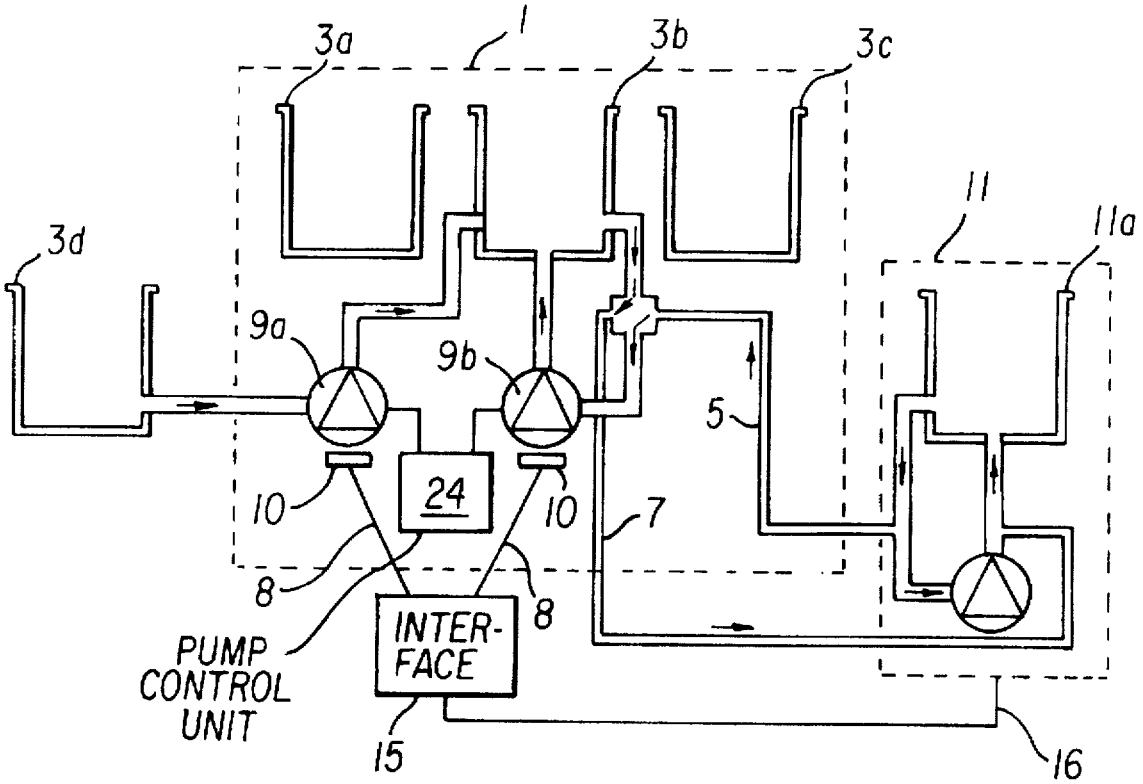
FIG. 1 is a schematic design of a film developing device with a connected silver recovery unit.

A device for interfacing between a film developing device 1 and a silver recovery unit 11 is used to obtain information on the operating state of the film developing device 1 for the silver recovery unit 11. FIG. 1 shows schematic design of a film developing device 1 sufficiently known from the prior art and a silver recovery unit 11. The film developing device 1 substantially comprises a developing bath 3a, at least one fixing bath 3b and one washing bath 3c. The silver recovery unit 11 is connected to the fixing bath 3b via at least one liquid line 5, 7. Silver from the developed films is deposited into the fixing bath 3b with fixing solution. The fixing solution is used up depending on the area of the developed film. The area of the developed film can be determined for example by a device as disclosed in German patent application DE-A-42 40 433.9. It is, therefore, necessary to supply fresh fixing solution, which is achieved generally from a supply container (3d) filled with fresh fixing solution.

Although the description is restricted to the monitoring of the operating state of a pump within the film development operation, it is obvious that with the present invention other pumps too, for example, between the fixing bath tank and the silver recovery unit, can be monitored in order to indicate their operating state.

Figure 2:
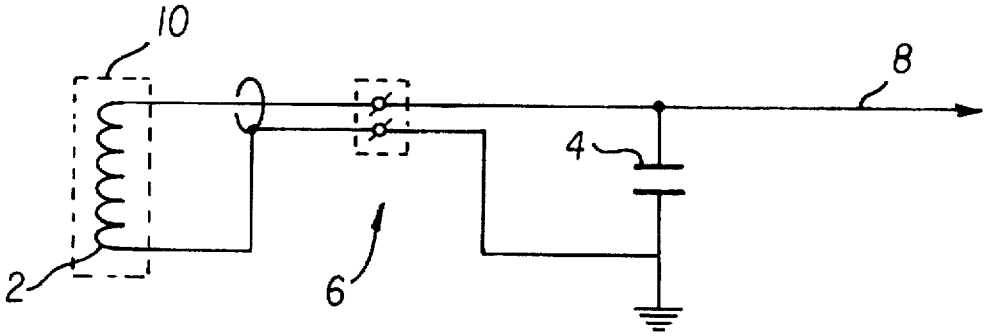
FIG. 2 is a circuit arrangement of an inductive sensor.
Figure 3:
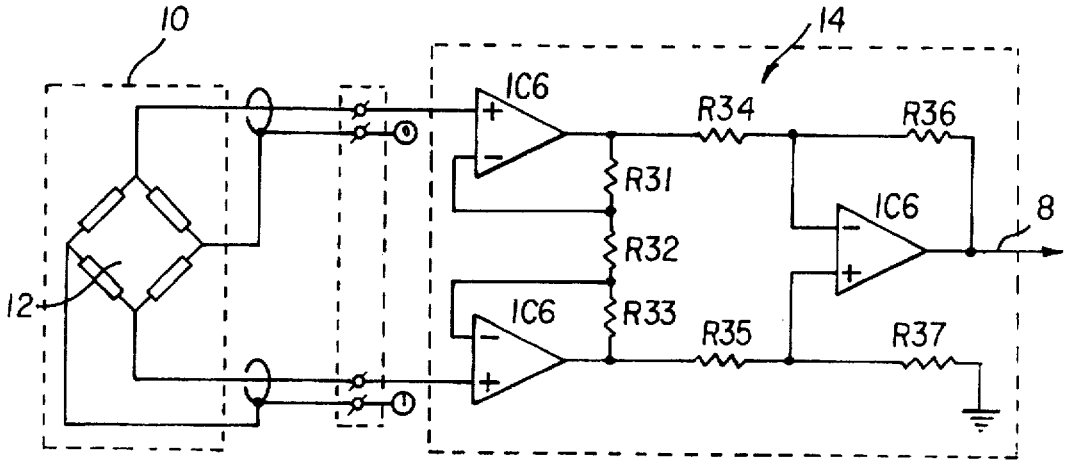
FIG. 3 is a circuit arrangement of a Hall sensor with an associated amplifier circuit.
Figure 4:
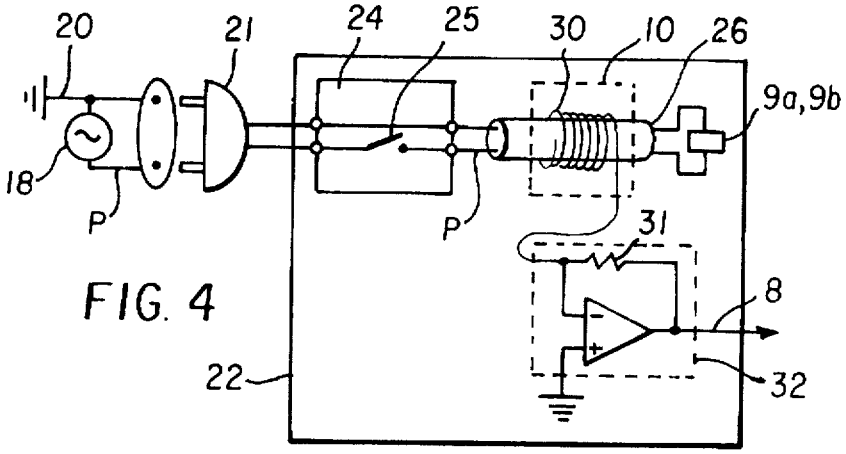
FIG. 4 is a circuit arrangement of a capacitive sensor.

Simple, inexpensive, universal, and dependable solutions for detection of the operating state of the film developing device 1 or of an actually occurring liquid movement between the supply container 3d and the film developing device 1, or circulation of the fixing bath 3d, are permitted by the sensors 10 shown in FIGS. 2 to 4. In the embodiments shown in FIGS. 2 and 3 of the sensors 10 for the interface, the latter are attached directly on or as close as possible to the respective electric pump 9a, 9b. In the embodiment disclosed in FIG. 4, it is sufficient to wind wire around the current supplying cable of the electric pump.

In all the cases mentioned here, it is not necessary to interfere with the electrical, electronic or hose pipes of the system (for example, flow detection) in order to obtain a signal for the operating state of the pump.

FIG. 2 discloses the possibility of inductive signal pickup. Accordingly, a coil 2 is provided for signal pickup. The known pumps operate with electric motors that generate a magnetic field that changes in time. As a result, voltages are induced in the coil 2 that permit conclusions about the operating state of the pump. The coil 2 itself serves as a sensor 10 which is connected in parallel to a capacitor 4 that forms together with the coil 2 a resonant circuit 6. This arrangement ensures filtering even before an electronic unit (see FIG. 6) intended for further processing. This results in an increase in the interference immunity compared with other signals. The signals picked up by the sensor are passed on via a line 8 to the series-connected electronic unit.

It has proved advantageous when the resonant circuit comprising coil and capacitor has a resonance frequency matched to the main component of the magnetic field generated by the pump 9a, 9b (e.g., 50 Hz). This dimensioning means that filtering takes place even before the electronic evaluation unit proper.

The sensor 10 used in FIG. 3 is a Hall sensor that reacts to the magnetic field of the electric motor of the pump. In the embodiment disclosed here, a Hall sensor is used that is a semiconductor module and reacts to the prevailing magnetic fields by a property change.

The sensor 10 that can be used here is a Hall element, model KMZ 10 B from Valvo. This integrated module uses the resistance change of the semiconductor when it enters a magnetic field (magneto-resistive). It is designed in the form of a bridge circuit 12. For further signal evaluation, a difference amplifier 14 is necessary. This amplifier, made up of IC6 and R31 to R37, is described in greater detail in Tietze, Schenk; "Halbleiter- Schaltungstechnik", Springer-Verlag, 1986. The signals processed by the difference amplifier are passed via a line 8 to the electronic unit intended for further processing (see FIG. 6).

FIG. 4 shows a third embodiment of the sensor 10. A generator 18, which in principle shows the power station, supplies the entire film developing device with electrical energy. A line 20 of the generator 18 is connected to the ground potential (protective ground). The electrical connection between the generator 18 and a developing machine 22 is made by a mains plug 21. The developing machine 22 shown here in diagrammatic form comprises a pump control unit 24, a connecting cable 26 and the pump 9a, 9b. The connecting cable 26 connects the pump control unit 24 and the pump 9a, 9b. The pump 9a, 9b is of no importance for the operation of the sensor 10 and has only been included in the drawing for clarity sake. The connecting cable 26 has over a certain length a wire 30 wound around it that acts as an electrode. The phase line P of the connecting cable 26 and the wound wire 30 form a capacitor. An electronic unit 32 keeps the potential of the wire-wound connecting cable 26 to zero (i.e., ground potential). A switch 25 is provided in the pump control unit 24 in the phase line P. When the switch 25 is closed, an electrical field is applied to the electrodes of this capacitor (comprising connecting cable 26 and wound wire 30). The capacitive reactive current now flowing can be measured by a resistor 31 and is used to signal the on/off state of the pump. The signal is passed via a line 8 to the electronic unit intended for further processing (see FIG. 6). Care must however always be taken with this sensor 10 that the switch 25 is in the phase line P.

Figure 5:
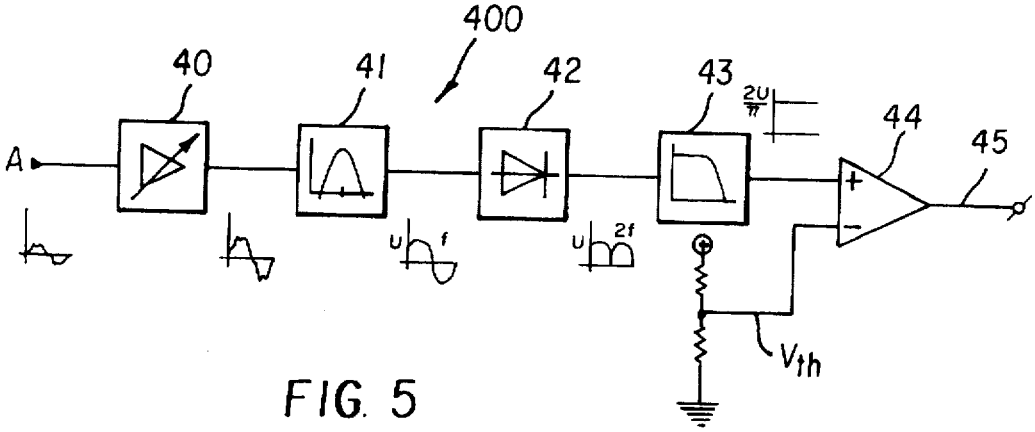
FIG. 5 is a block diagram for evaluation and further processing of the electric signals from the sensors.
Figure 6:
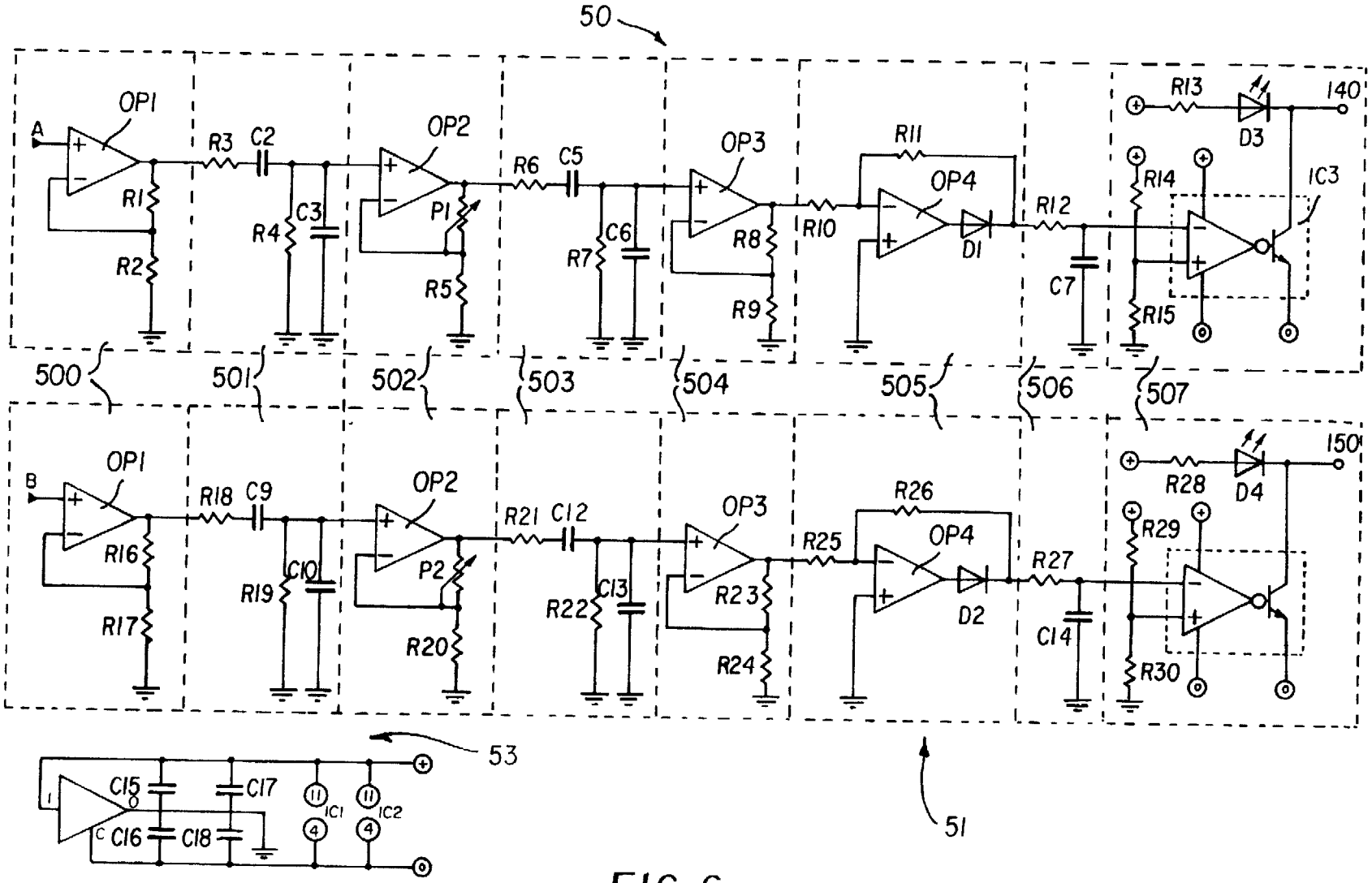
FIG. 6 is a circuit diagram for implementing the block diagram shown in FIG. 5.

The operating principle of the electronic unit shown in FIG. 6 is made clear in FIG. 5.

The signal from the sensor 10 arrives via the line 8 of the respective sensor at point A in the circuit 400. The signal first reaches an amplifying means 40 where it is amplified. The amplified signal then passes to a filtering means 41 where it is filtered. Following rectifying means 42 perform rectification, with a DC voltage share of $2U/\pi$proportional to the peak value U of the sensor signal being generated. Seen from the system technology viewpoint, this is a circuit with a non-linear transmission function. The implementation of this function has the effect that a DC voltage share and harmonic frequencies of the sensor signal frequency are created in the spectrum of the signal.

This signal is passed to a following low-pass filter 43 with a very low limit frequency (compared to the sensor signal frequency.) The low-pass filter 43 ensures that practically only the DC voltage share is passed to a comparator 44. The latter compares this DC voltage share with a voltage $V_{th}$ applied to the other input of the comparator 44. If $V_{th}$ is exceeded, the comparator 44 switches to the active state and the silver recovery unit connected to output 45 recognizes that the pump is active. This part of the electronic unit must be provided for every pump of which the operating state has to be monitored.

Since the sensor signals can vary greatly between different pump models and also depending on the location of the signal pickup, adjustment of the amplification is necessary. This is performed during installation.

Mode of Operation of the Electronic Unit

The circuit diagram 50 from FIG. 6 largely represents a direct implementation of the block diagram shown in FIG. 5. The signal coming from the sensors 10 is fed into the circuit at point A or point B and arrives at a first amplifier 500. The latter is made up of an operational amplifier OP1 and resistors R1 and R2. Amplification is derived from the ratio (R1+R2)/R2 (Tietze, Schenk; "Halbleiter-Schaltungstechnik", Springer-Verlag, 1986). The amplified signal is now passed to a filter 501 representing a bandpass filter, comprising a resistor R3, a capacitor C2, a resistor R4 and a capacitor C3. The mid-frequency of the bandpass filter is calculated from $1/(2\pi*R3*C2)$, where R3=R4 and C2=C3 (Tietze, Schenk:"Halbleiter-Schaltungstechnik", Springer-Verlag, 1986). With an operational amplifier OP2, a further amplifier 502 with a potentiometer P1 and a resistor R5 follows. The amplification of the amplifier 502 is adjustable with (P1+R5)/R5. The signal then passes a further bandpass filter 503 comprising a resistor R6, a capacitor C5, a resistor R7 and a capacitor C6. The mid-frequency is identical to that of the first filter 501. With an operational amplifier OP3 in conjunction with resistors R8 and R9, a third amplifier 504 follows in the signal path. The rectifying means 42 in the block diagram (FIG. 5) is provided by a rectifier circuit 505 comprising an operational amplifier OP4, resistors R10 and R11, and a diode D1 (RCA; "Databook, Integrated Circuits for Linear Applications"; 1986). With a positive half-wave of the signal at R10, a negative signal follows at the anode of the diode D1 as a result of inversion of the operational amplifier OP4. Diode D1 blocks and practically the same signal is applied at the cathode of the diode D1. In the case of negative half-waves, the diode D1 becomes conducting and the circuit section behaves like an inverting amplifier, with amplification 1 (since resistor R10=R11). To summarize, this means that negative half-waves are inverted, positive half-waves pass through the circuit unchanged. To allow positive half-waves really to pass unchanged, the current through the resistors R10 and R11 must be equal to zero. This is only the case when the circuit section is unloaded. This requirement is only partially met in the circuit, since the rectifier is followed by a low-pass filter 506 comprising a resistor R12 and a capacitor C7. The rectifier is therefore loaded with the impedance of the low-pass filter 506 ($R12+1/(2\pi*f*C7)$). The low-pass filter 506 comprising resistor R12 and capacitor C7 is followed by a comparator 507 comprising an integrated circuit IC3. Resistors R14 and R15 determine the switching threshold $V_{th}$ (cf. FIG. 5). If the voltage at the input of the comparator 507 rises above $V_{th}$, the output transistor switches through and a current flows through a resistor R13 and an LED D3. The LED D3 lights up and the potential at the output 140 falls, indicating to the connected silver recovery unit that the appropriate pump has been activated. Since the operating state of two pumps 9a, 9b generally has to be detected, FIG. 6 shows a further circuit 5 for the electronic section of a second pump. Here the signal coming from a second sensor is fed into the circuit 51 at point B. The two electronic parts shown here of the circuits 50 and 51 are identical in design and hence also in their mode of operation.

Circuits 50 and 51 do not have their own voltage supply and are supplied from the silver recovery unit with +5 V (indicated by the + sign in the circuit diagram). However, since a dual voltage supply is necessary for the operational amplifiers OP1, OP2, OP3, OP4 used, an integrated circuit 53 is used. This integrated circuit 53 (designation: TLE2426) generates an artificial ground at 2.5 V, so that ±2.5 V are available for the operational amplifiers OP1, OP2, OP3 and OP4. The operational amplifiers OP1, OP2, OP3 and OP4 of model TLC2274 used are special models having an extremely low saturation voltage at the output and which are therefore particularly suitable for low operating voltages.

The detailed dimensions of the circuit are not dealt with here, since it is clear to every person skilled in the art how the components of the individual circuits 50, 51 and 53 have to be selected.

Parts List:

1 Film developing device
2 Coil
3a Developing bath
3b Fixing bath
3c Washing bath
3d Supply container with regenerate
4 Capacitor(for coil 2)
5 Liquid line
6 Resonant circuit
7 Liquid line
8 Line: sensor interface
9a Regenerating pump
9b Circulating pump
10 Sensor
11 Silver recovery unit
11a Electrolysis unit
12 Bridge circuit
14 Difference amplifier
15 Interface
16 Connecting cable
18 Generator
20 Protective ground
21 Mains plug
22 Developing machine
24 Pump control unit
25 Switch
26 Connecting cable: control unit/pump
30 Wound wire
31 Resistor for reactive current measurement
32 Electronic unit: (keeps wire at zero potential)
40 Amplifying means
41 Filter means
42 Rectifying means
43 Low-pass filter
44 Comparator
45 Comparator output
50 Electronic unit for one sensor signal
51 Electronic unit for one sensor signal
53 TLE2426
140 Electronic unit output
150 Electronic unit output
400 Block circuit
500 Amplifier 1
501 Filter 1
502 Amplifier 2
503 Bandpass filter
504 Amplifier 3
505 Rectifier
506 Low-pass filter
507 Comparator
P Phase line

We claim:

1. A device for interfacing between a film developing device and a silver recovery unit for checking the operating condition of said film developing device, said film developing device having at least one electric motor-driven pump, a plurality of liquid lines and a pump/machine control unit, and at least one sensor for detection of the operating condition of said film developing device is installed outside the at least one pump of said film developing device such that said sensor is fastened directly to a housing wall of said motor-driven pump.

2. The device according to claim 1, characterized in that said sensor is attached to an electric power line to said motor-driven pump.

3. The device according to claim 2, characterized in that said electric power line of said pump has a wire wound around it several times, where said wire forms with the phase line P of said electric power line a capacitor, and an electronic unit series-connected to said wire supplies a measuring signal.

4. The device according to claim 3, characterized in that said measuring signal can be ascertained from a capacitive reactive current.

5. The device according to claim 1, characterized in that said sensor comprises a coil attached in the housing wall of said pump, and in that a capacitor is series-connected to said coil to form a resonant circuit.

6. The device according to claim 5, characterized in that the resonance frequency of said resonant circuit formed from said coil and said capacitor is matched to the main component of the magnetic field generated by said motor-driven pump.

7. The device according to claim 1, characterized in that said sensor is a Hall element series-connected to a corresponding amplifier circuit.

8. The device according to claim 1, characterized in that the output signal of said sensor is passed to a series-connected electronic circuit, said circuit comprising a series connection of an amplifying means, a first filtering means, a rectifying means, a second filtering means and a comparator.

* * * * *